United States Patent [19]

Yamamoto

[11] 4,181,101

[45] Jan. 1, 1980

[54] TWO-CYCLE INTERNAL COMBUSTION ENGINES WITH SCAVENGER MEANS

[75] Inventor: Yasuo Yamamoto, Hamamatsu, Japan

[73] Assignee: Yamaha Hatsudoki Kabushiki Kaisha, Iwata, Japan

[21] Appl. No.: 841,521

[22] Filed: Oct. 12, 1977

[30] Foreign Application Priority Data

Oct. 13, 1976 [JP] Japan ..... 51-138060

[51] Int. Cl.[2] ..... F02B 33/28

[52] U.S. Cl. ..... 123/73 A; 123/73 V

[58] Field of Search ..... 123/65 E, 73 A, 73 AD, 123/73 V

[56] References Cited

U.S. PATENT DOCUMENTS

| | | | |
|---|---|---|---|
| 1,606,424 | 11/1926 | Irgens et al. | 123/73 A |
| 3,132,635 | 5/1964 | Heidner | 123/73 A |
| 3,859,967 | 1/1975 | Turner et al. | 123/73 A |

FOREIGN PATENT DOCUMENTS

| | | |
|---|---|---|
| 43-5206 | 6/1968 | Japan . |
| 51-13645 | 12/1976 | Japan . |

*Primary Examiner*—Ira S. Lazarus

*Attorney, Agent, or Firm*—Donald D. Mon

[57] ABSTRACT

A fuel scavenger for a two-cylinder, two-cycle horizontal upper and under type internal combustion engine. The engine has a crankcase with a revolving crankshaft which is turned by the reciprocating movement of a piston in each of the cylinders. A carburetor supplies air/fuel mixture to the crankcase via respective intake passages and reed valves. A fuel catcher is located in each crankcase, substantially shielded from the scouring action of air/fuel mixture impelled by the crankshaft, and the fuel catcher of each cylinder is connected to the intake passage of the other cylinder via a respective check valve.

4 Claims, 2 Drawing Figures

TWO-CYCLE INTERNAL COMBUSTION ENGINES WITH SCAVENGER MEANS

The invention relates to an intake gas distributor for use in an two-cycle internal combustion engine including two cylinders and one carburetor.

Uniformity of distrubution of the intake air/fuel mixture between the upper and lower cylinders is dependent on engine operating rate, intake gas distributor shape, reed valve arrangement, and other conditions. For example, in a two-cycle internal combustion engine of the type including two horizontal cylinders arranged one above the other, when supplying therethrough an intake mixture from a carburetor into the upper and lower cylinders, it has been found that a learn air/fuel mixture will be supplied into the upper cylinder and a richer air/fuel mixture will be supplied into the lower cylinder due to the weight of the fuel, resulting in poor engine output power. This is true particularly when the engine is operating at a low rate and fuel atomization is poor.

Therefore, the present invention has for its object to provide an improved two-cycle internal combustion engine which can eliminate the above described disadvantages found in the conventional engines whereby to improve engine output power and which can remove fuel that is unatomized and adhering to the wall surface in the cylinders. This is accomplished in accordance with the present invention by providing fuel catchers in the bottoms of the crankcases in the cylinders, each fuel catcher being connected through a respective check valve to the intake passage of the other cylinder.

One embodiment of an intake gas distributor in accordance with the present invention will now be described in connection with an outboard two-cycle internal combustion engine with reference to the accompanying drawings, in which.

Figure 1:
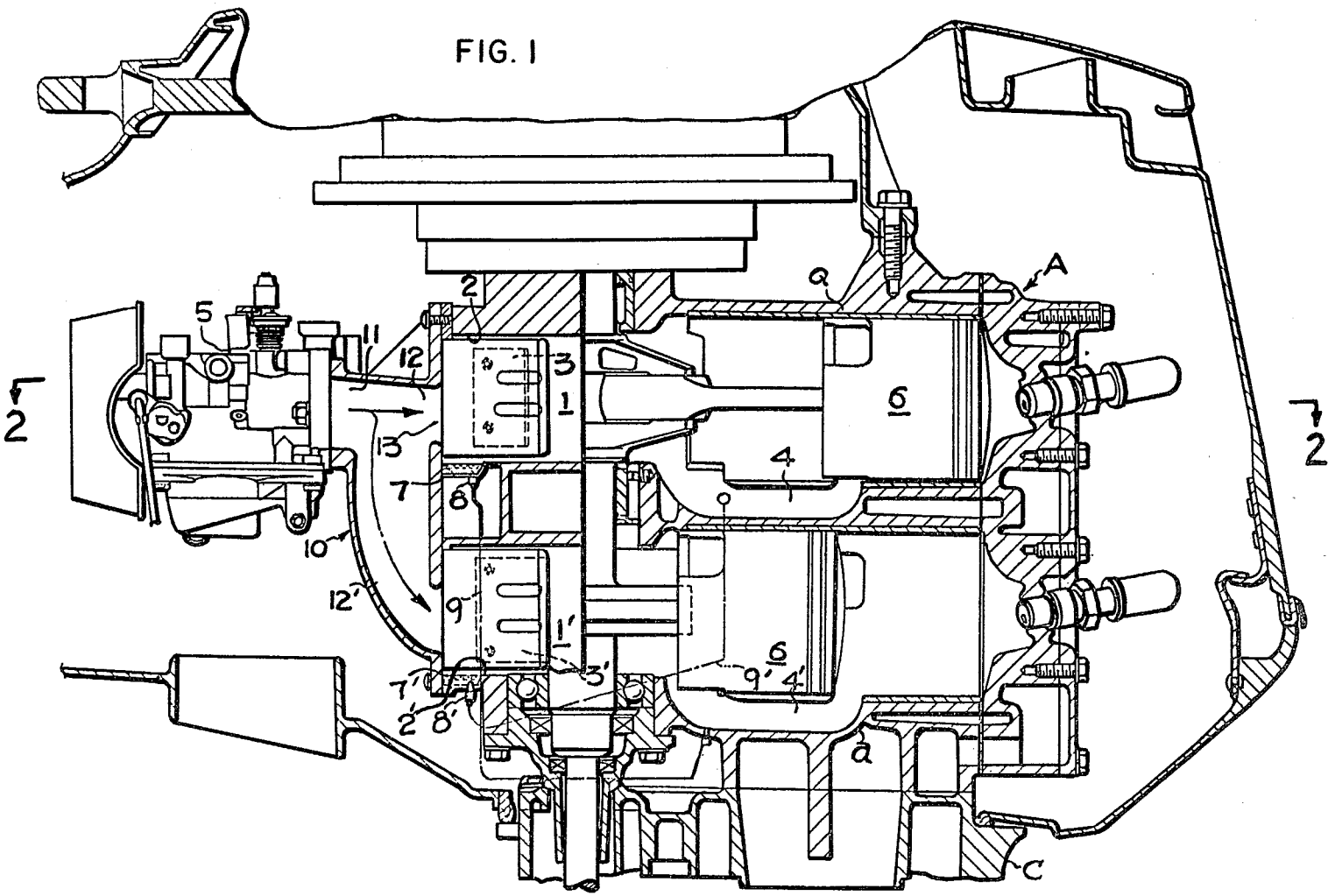
FIG. 1 is a cross-section taken at line 1—1 in FIG. 2.
Figure 2:
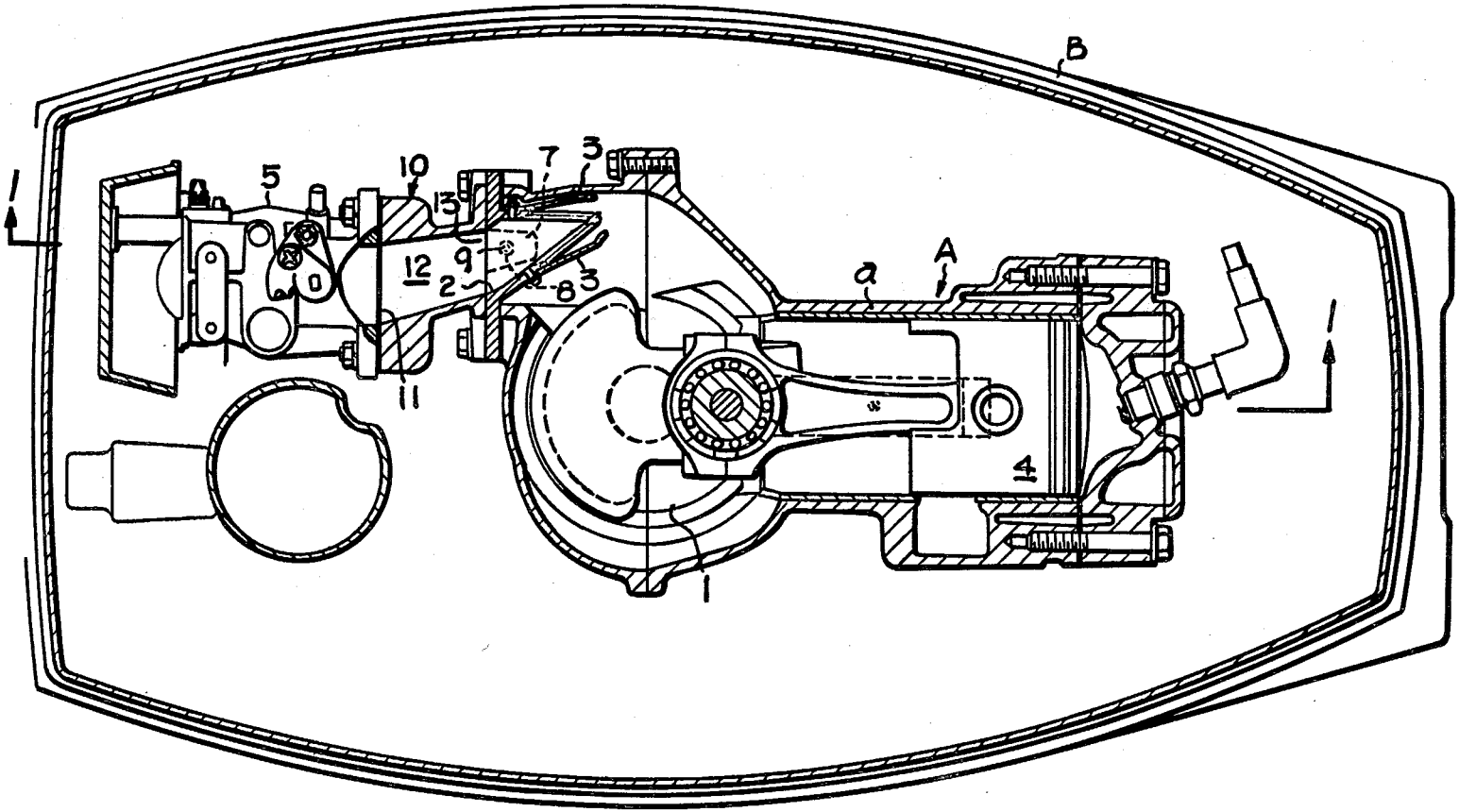
FIG. 2 is a cross-section taken at line 2—2 in FIG. 1.

In FIG. 1, the reference letter (A) designates a two-cycle internal combustion engine including two horizontal cylinders (a) and (a') arranged one vertically above the other. The reference numerals 1 and 1' indicate crankcases, the numerals 2 and 2' intake ports, the numerals 3 and 3' reed valves, the numerals 4 and 4' intake passages, the numeral 5 a carburetor, the numerals 6 and 6' pistons, and the numeral 10 an intake gas distributor.

In the figures, the reference letter (B) designates an engine cowling and the letter (C) a casing.

The reference numeral 10 designates an intake gas distributor which has its inlet 11 connected to the carburetor 5 and is bifurcated to form upper and lower distributor passages 12 and 12' respectively connected to the intake ports 2 and 2' of the upper and lower cylinders (a) and (a'), whereby an air/fuel mixture flowing from the carburetor into the inlet 11 is supplied through the upper and lower distributor passages 12 and 12' into the upper and lower cylinders (a) and (a'), respectively, during the intake stroke of the engine.

The inlet 11 of the intake gas distributor 10 is located near the upper distributor passage 12 coaxially therewith so that the mixture flow through the inlet 11 can be supplied directly into the upper cylinder (a) during the intake stroke of the engine to reduce the tendency of the fuel to fall down into the lower passage due to its weight when the engine is operating at a low rate with poor fuel atomization.

The lower passage 12' has one of its ends connected to the upper passage 12 on the way thereof and is extended downward to the lower cylinder so as to have an increased length in comparison with the upper passage 12. This increases the resistance to flow of the mixture through the lower passage. The increase in mixture flow resistance can be adjusted by properly selecting the diameter of the lower passage at its downstream end. The difference in mixture flow resistance between the upper and lower passages 12 and 12' can be compensated by reducing the diameter of the upper passage at its downstream end 13 to increase the resistance of the mixture flow through the upper passage 12.

The fuel catchers 7 and 7' are provided in the bottoms of the crankcases 1 and 1' for collecting unatomized fuel in the crankcases 1 and 1'. The fuel catcher 7 of the upper cylinder (a) is connected through a check valve 8 to the intake passage 4' of the lower cylinder (a') by means of a pipe 9 ("scavenger conduit"). The fuel catcher 7' of the lower cylinder (a') is connected through a check valve 8' to the intake passage 4 of the upper cylinder (a) by means of pipes 9'.

Thus, the fuel stored in the fuel catchers 7 and 7' is supplied through the passages 4' and 4 into the cylinders (a') and (a), respectively, by the pressure difference between the crankcases 1 and 1' and the intake passages 4 and 4' of the cylinders (a) and (a') during the compression stroke of the engine.

Although the present invention has been described in connection with an arrangement associated with an intake gas distributor having an improved shape to fully distribute the intake mixture, the present invention is also applicable to the conventional type intake gas distributor.

As described above, the present invention can utilize the pressure difference between the crankcases and the intake passages of the two different cylinders to scavenge the unatomized fuel and supply it to the intake passages, thereby making more uniform the density of the mixtures supplied into the upper and lower cylinders. This can improve engine output power and can scavenge and recover the unatomizated fuel to improve engine performance.

What is claimed is:

1. In a two-cycle, two-cylinder internal combustion engine having a pair of crankcases, a pair of horizontal cylinders, one in each crankcase, one cylinder being disposed vertically above the other, a rotary, vertically-extending crankshaft in said crankcases rotated as the consequence of reciprocating movement of a piston in each of said cylinders, a carburetor for supplying air/fuel mixture to the crankcases through distributor passages, and an intake passage for each cylinder interconnecting the inside of the respective crankcase to the respective cylinder for valved supply of air/fuel mixture to said respective cylinder, the improvement comprising: a fuel catcher in the form of a horizontal depression inside each crankcase at the bottom thereof, disposed radially outwardly from the rotating portion of the crankshaft in the respective crankcase, a reed valve in the air/fuel mixture path to each crankcase, said reed valve extending into its respective crankcase, vertically overhanging the respective fuel catcher, and vertically spaced therefrom so as to leave a gap between them, each said reed valve being disposed radially outward from said rotating portions of the crankshaft in the respective crankcase, a respective scavenger conduit from the fuel catcher of each crankcase to the intake passage of the other crankcase, and a unidirectional check valve in each scavenger conduit which check valves permit flow toward the intake passage, but not the reverse.

2. Apparatus according to claim 1 in which each said reed valve extends for the major portion of the width of its respective crankcase.

3. Apparatus according to claim 1 in which each said reed valve is a V-type.

4. Apparatus according to claim 2 in which each said reed valve is a V-type.

* * * * *